US008780036B2

(12) United States Patent
Park

(10) Patent No.: US 8,780,036 B2
(45) Date of Patent: Jul. 15, 2014

(54) DISPLAY APPARATUS AND METHOD FOR DRIVING BACKLIGHT APPLIED TO THE SAME

(75) Inventor: Jun-su Park, Daejeon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 337 days.

(21) Appl. No.: 13/182,101

(22) Filed: Jul. 13, 2011

(65) Prior Publication Data

US 2012/0105441 A1 May 3, 2012

(30) Foreign Application Priority Data

Nov. 3, 2010 (KR) ..... 10-2010-0108718

(51) Int. Cl.
*G09G 3/36* (2006.01)

(52) U.S. Cl.
USPC ..... 345/102

(58) Field of Classification Search
USPC ..... 345/102, 690, 204, 691
See application file for complete search history.

(56) References Cited

U.S. PATENT DOCUMENTS

| | | | | |
|---|---|---|---|---|
| 2006/0022935 | A1* | 2/2006 | Sakai et al. | 345/102 |
| 2008/0018575 | A1* | 1/2008 | Kobayashi et al. | 345/87 |
| 2008/0297671 | A1* | 12/2008 | Cha et al. | 349/15 |
| 2009/0122087 | A1* | 5/2009 | Maruyama et al. | 345/690 |
| 2012/0154462 | A1* | 6/2012 | Hempson et al. | 345/691 |

FOREIGN PATENT DOCUMENTS

| | | | |
|---|---|---|---|
| KR | 10-0724748 | A | 6/2007 |
| KR | 10-2009-0044300 | A | 5/2009 |

* cited by examiner

*Primary Examiner* — Pegeman Karimi
(74) *Attorney, Agent, or Firm* — Sughrue Mion, PLLC

(57) ABSTRACT

A display apparatus and a backlight driving method applied to the display apparatus are provided. The display apparatus controls to drive light sources of a backlight unit according to an image scanning scheme of a display panel and controls the luminance of each light source to equalize the luminance of the backlight emitting from the backlight unit with respect to a location of the light source.

23 Claims, 10 Drawing Sheets

DISPLAY APPARATUS AND METHOD FOR DRIVING BACKLIGHT APPLIED TO THE SAME

CROSS-REFERENCE TO RELATED APPLICATION

This application claims priority from Korean Patent Application No. 10-2010-0108718, filed Nov. 3, 2010, in the Korean Intellectual Property Office, the disclosure of which is incorporated herein by reference in its entirety.

BACKGROUND

1. Field

Apparatuses and methods consistent with one or more exemplary embodiments relate to a display and a backlight driving applied to the display. More specifically, the one or more exemplary embodiments relate to a display apparatus for displaying a screen using a backlight, and a method for driving the backlight applied to the display apparatus.

2. Description of the Related Art

An LED, which features high performance and a long lifetime, has been increasingly used in a variety of applications and is now used as a backlight of a display apparatus.

For example, an LCD display apparatus employs a direct LED as the backlight. In addition, an edge LED has been adopted as the backlight. An LCD-TV using the edge LED as the backlight has attracted positive reviews from consumers based on the reduced thickness that is possible by using the edge LED.

According to one method of driving an edge backlight apparatus, a progressive method sequentially turns on light sources on a row basis. This method is used in a 3D display apparatus to prevent crosstalk.

However, when the light source is turned on in sequence, luminance imbalance varies the luminance according to the location of the light source with respect to one screen. In this regard, a method for preventing the luminance imbalance is desirable.

SUMMARY

One or more exemplary embodiments overcome the above disadvantages and other disadvantages not described above. Also, the is the exemplary embodiments are not required to overcome the disadvantages described above, and may not overcome any of the problems described above.

According to an aspect of one or more exemplary embodiments, there is provided a display apparatus for controlling light sources of a backlight unit according to an image scanning scheme of a display panel. One or more exemplary embodiments provide a display apparatus that regulates the luminance of each light source to equalize luminance of a backlight emitting from the backlight unit with respect to a location of the light source, and a method for driving the backlight applied to the display apparatus.

According to an aspect of one or more exemplary embodiments, a display apparatus includes a display panel for displaying an image; a backlight unit comprising a plurality of light sources that emits backlight to the display panel; and a controller that drives the light sources of the backlight unit according to an image scanning scheme of the display panel, and controls a luminance of each light source to make a luminance of the backlight emitted from the backlight unit, uniform with respect to the location of the light source.

The plurality of the light sources may emit the backlight row by row in a screen, and the controller may control the plurality of light sources to emit the backlight in sequence row by row, according to an image scanning order in the display panel.

The controller may control the backlight unit to operate according to a progressive scheme.

The backlight unit may be an edge type backlight unit which arranges the light sources on a left edge side and a right edge side of the screen.

A unit for emitting the backlight in the backlight unit may include N-ary rows, and the controller may overlap a period for lighting a K-row (K is a natural number between 1 and N) light source partially with a period for lighting a (K+1)-row light source.

In the period for lighting the K-row light source, the controller may decrease the luminance of the K-row light source for the period overlapping the lighting period of the (K+1)-row light source, to a level below the luminance of the K-row light source for the period not overlapping the lighting period of the (K+1)-row light source.

In the lighting period of the (K+1)-row light source, the controller may decrease the luminance of the (K+1)-row light source for the period overlapping the lighting period of the K-row light source, to a level below the luminance of the (K+1)-row light source for the period not overlapping the lighting period of the K-row light source.

The controller may cause the sum of the K-row light source luminance and the (K+1)-row light source luminance during the period for lighting both of the K-row light source and the (K+1)-row light source, equal the K-row light source luminance of the lighting period of the K-row light source turned on alone.

The controller may control the luminance of each light source to equalize the luminance of the backlight emitting from the backlight unit according to a location of the light source by controlling a duty ratio of a driving signal applied to the each light source.

The display panel may display a 3D image comprising a left-eye image and a right-eye image, and the controller may control the light sources of the backlight unit according to a 3D image scanning scheme in the display panel.

According to another aspect of one or more exemplary embodiments, there is provided a method for driving a backlight of a display apparatus which includes a display panel and a backlight unit including a plurality of light sources, which includes controlling a luminance of each light source to make a luminance of the backlight emitted from the backlight unit uniform with respect to the location of the light source; and driving the light sources with the controlled luminance according to an image scanning scheme of the display panel.

The driving operation may include emitting the backlight in sequence row by row with respect to a screen, according to an image scanning order in the display panel.

The driving operation may drive the backlight unit according to a progressive scheme.

The backlight unit may be an edge type backlight unit which arranges the light sources in a left edge side and a right edge side of the screen.

A unit for emitting the backlight in the backlight unit may include N-ary rows, and the driving operation may overlap a period for lighting a K-row (K is a natural number between 1 and N) light source partially with a period for lighting a (K+1)-row light source.

In the period for lighting the K-row light source, the luminance regulating operation may decrease the luminance of the K-row light source for the period overlapping the lighting period of the (K+1)-row light source, to a level below the luminance of the K-row light source for the period not overlapping the lighting period of the (K+1)-row light source.

In the lighting period of the (K+1)-row light source, the luminance regulating operation may decrease the luminance of the (K+1)-row light source for the period overlapping the lighting period of the K-row light source, to a level below the luminance of the (K+1)-row light source for the period not overlapping the lighting period of the K-row light source.

The luminance regulating operation may cause the sum of the K-row light source luminance and the (K+1)-row light source luminance during the period for lighting both of the K-row light source and the (K+1)-row light source, equal the K-row light source luminance of the lighting period of the K-row light source turned on alone.

The luminance regulating operation may regulate the luminance of each light source to equalize the luminance of the backlight emitting from the backlight unit according to a location of the light source by controlling a duty ratio of a driving signal applied to the each light source.

The driving operation may control the light sources of the backlight unit according to a scheme for scanning a 3D image which comprises a left-eye image and a right-eye image in the display panel.

BRIEF DESCRIPTION OF THE DRAWINGS

The above and/or other aspects will become more apparent by describing certain exemplary embodiments with reference to the accompanying drawings, in which.

DETAILED DESCRIPTION OF EXEMPLARY EMBODIMENTS

Figure 1:
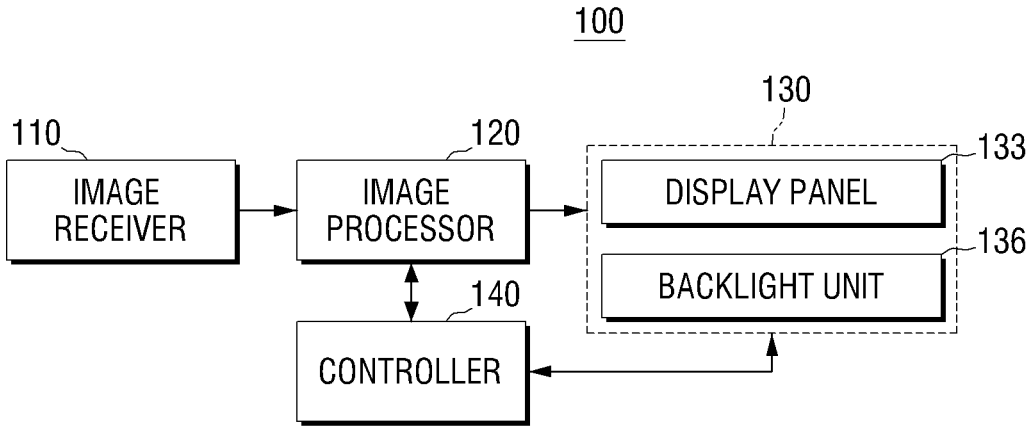
FIG. 1 is a block diagram of a display apparatus according to an exemplary embodiment.

Exemplary embodiments are described in greater detail below with reference to the accompanying drawings.

In the following description, like drawing reference numerals are used for the like elements, even in different drawings. The matters defined in the description, such as detailed construction and elements, are provided to assist in a comprehensive understanding of the exemplary embodiments. However, the exemplary embodiments can be practiced without those specifically defined matters. Also, well-known functions or constructions are not described in detail since they would obscure the exemplary embodiments with unnecessary detail.

FIG. 1 is a block diagram of a display apparatus 100 according to an exemplary embodiment. As shown in FIG. 1, the display apparatus 100 includes an image receiver 110, an image processor 120, a display unit 130, and a controller 140.

The image receiver 110 receives an image signal and image data from an external input device such as broadcasting station or satellite, via a wired or wireless medium. For example, the image receiver 110 can be a tuner for receiving a broadcast signal, or an A/V interface for receiving images from an external image device.

The image processor 120 applies signal processing, such as video decoding, video scaling, Frame Rate Conversion (FRC), luminance control, and hue control, to the image output from the image receiver 110.

The display unit 130 displays the input image on a screen. The display unit 130 includes a display panel 133 and a backlight unit 136 as shown in FIG. 1.

The display panel 133 displays the image signal-processed by the image processor 120. Herein, the display panel 133 may, for example, employ a Liquid Crystal Display (LCD) panel. Note that the display panel 133 may employ other panels using the backlight. More specifically, the display panel 133 scans the input image signal based on each individual pixel line. Herein, the pixel line indicates a horizontal pixel line in the screen. By sequentially scanning the image signal from the top pixel line to the bottom pixel line, the display panel 133 displays the image.

When the input image is a 3D image including a left-eye image and a right-eye image, the display panel 133 alternately displays the left-eye image and the right-eye image.

The backlight unit 136 emits the backlight to the display panel 133. Since the display panel 133 cannot produce the light by itself, the backlight unit 136 emits white light to the display panel 133 as the backlight.

Figure 3A:
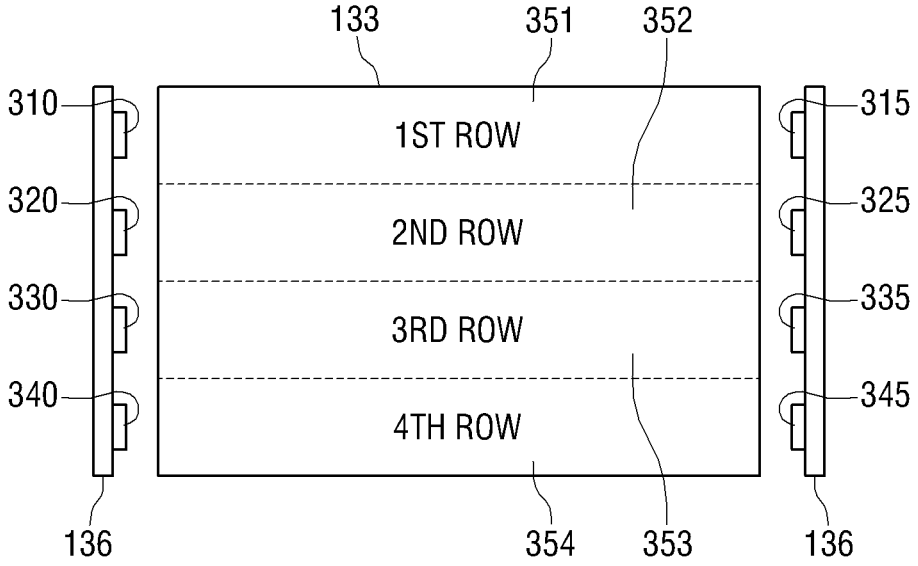
FIG. 3A is a diagram of the backlight including four rows according to an exemplary embodiment.

The backlight unit 136 includes a plurality of light sources. Herein, the light sources may, for example, employ a Light Emitting Diode (LED). The backlight unit 136 can be an edge-type backlight unit. In more detail, the backlight unit 136 can be of the edge type backlight unit which arranges the light sources in the left edge side and in the right edge side of the screen, which is shown in FIG. 3A.

The light sources of the backlight unit 136 can emit the backlight on a row basis with respect to the screen. Herein, the row basis indicates a certain horizontal region of the screen. The light source of the backlight unit 136 emits light in the horizontal direction of the screen. Hence, each light source of the backlight unit 136 is disposed in the horizontal region for emitting the light, which is referred to as a row-based region for the light source emitting the light, to be explained by referring to FIG. 3A.

The controller 140 controls operations of the display apparatus 100. In detail, the controller 140 controls the light sources of the backlight unit 136 according to the image scanning scheme of the display panel 133. That is, according to the order for scanning the image in the display panel 133, the controller 140 controls the backlight in sequence row by row. When the backlight unit 136 is operated as above, the controller 140 controls the backlight unit 136 in a progressive scheme.

By driving the light sources of the backlight unit 136 in sequence according to the image scanning order of the display panel 133, the controller 140 can prevent crosstalk when the 3D image is displayed.

In so doing, the controller 140 controls the luminance of each light source to equalize the luminance of the backlight emitted from the backlight unit 136 with respect to the location of the light source. More specifically, when one light source emits light, the controller 140 controls the light to be emitted at two or more luminance levels, rather than with a constant luminance, during the lighting period. To equalize the luminance of a period in which two light sources emit light, and the luminance of a period in which one light source alone emits light, the controller 140 controls the luminance at multiple values during one lighting period. Herein, the lighting period indicates the time during which one light source is turned on. The controller 140 may control the luminance by regulating a duty ratio for the driving signal of the light source.

More specifically, it is assumed that the unit of the backlight unit 136 for scanning the backlight includes N-ary rows. The controller 140 causes the lighting period of K-row light source (K is a natural number between 1 and N) to partially overlap with the lighting period of the (K+1)-row light source. During the lighting period (A period and B period in FIG. 3C) of the K-row light source, the controller 140 decreases the luminance of the K-row light source for the period (the B period of FIG. 3C) overlapping the lighting period of the (K+1)-row light source to a level below the luminance of the K-row light source for the period (the A period of FIG. 3C) not overlapping the lighting period of the (K+1)-row light source.

During the lighting period (the B period and the C period in FIG. 3C) of the (K+1)-row light source, the controller 140 decreases the luminance of the (K+1)-row light source for the period (the B period of FIG. 3C) overlapping the lighting period of the K-row light source, to a level below the luminance of the (K+1)-row light source for the period (the C period of FIG. 3C) not overlapping the lighting period of the K-row light source.

Through the luminance control described above, the controller 140 causes the sum of the K-row light source luminance and the (K+1)-row light source luminance during the lighting period (the B period of FIG. 3C) of both of the K-row light source and the (K+1)-row light source, to equal the K-row light source luminance of the lighting period (the A period of FIG. 3C) of the K-row light source alone. This luminance control is shown in FIGS. 3A through 3D.

When the 3D image is input, the controller 140 controls the light sources of the backlight unit 136 according to the scanning scheme of the 3D image in the display panel 133.

By regulating the luminance during the lighting period of each light source at several values, the display apparatus 100 can reduce luminance imbalance according to the location of the light source and uniformly maintain the luminance. When displaying the 3D image, the display apparatus 100 can prevent the crosstalk by enhancing the uniformity of the luminance.

Figure 2:
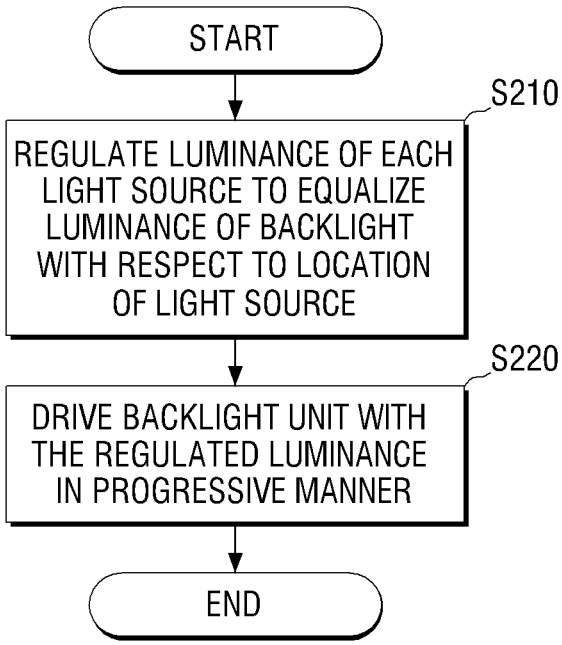
FIG. 2 is a flowchart of a method for driving a backlight of the display apparatus according to an exemplary embodiment.

Now, a method for driving the backlight of the display apparatus 100 is explained by referring to FIG. 2. FIG. 2 is a flowchart of the method for driving the backlight of the display apparatus 100 according to an exemplary embodiment.

The display apparatus 100 regulates the luminance of each light source to equalize the luminance of the backlight emitted from the backlight unit 136 with respect to the location of the light source (S210). In detail, when one light source emits light, the display apparatus 100 emits light with two or more luminance levels, rather than emitting the light with a constant luminance, during the lighting period. To make the luminance of the lighting period of two light sources equal to the luminance of the lighting period of one light source, the display apparatus 100 regulates the luminance in one lighting period at several values. Herein, the lighting period indicates the time for turning on the light source. The display apparatus 100 may control the luminance by regulating the duty ratio for the driving signal of the light source.

More specifically, it is assumed that the unit of the display apparatus 100 for scanning the backlight includes N-ary rows. The display apparatus 100 causes the lighting period of the K-row light source (K is the natural number between 1 and N) to partially overlap with the lighting period of the (K+1)-row light source. During the lighting period (the A period and the B period in FIG. 3C) of the K-row light source, the display apparatus 100 decreases the luminance of the K-row light source for the period (the B period of FIG. 3C) overlapping the lighting period of the (K+1)-row light source, to a level below the luminance of the K-row light source for the period (the A period of FIG. 3C) not overlapping the lighting period of the (K+1)-row light source.

During the lighting period (the B period and the C period in FIG. 3C) of the (K+1)-row light source, the display apparatus 100 decreases the luminance of the (K+1)-row light source for the period (the B period of FIG. 3C) overlapping the lighting period of the K-row light source, to a level below the luminance of the (K+1)-row light source for the period (the C period of FIG. 3C) not overlapping the lighting period of the K-row light source.

Through the luminance control described above, the display apparatus 100 causes the sum of the K-row light source luminance and the (K+1)-row light source luminance during the lighting period (the B period of FIG. 3C) of the K-row light source and the (K+1)-row light source turned on together, to equal the K-row light source luminance during the lighting period (the A period of FIG. 3C) of the K-row light source turned on alone. This luminance control is shown in FIGS. 3A through 3D.

Next, the display apparatus 100 drives the light sources of the backlight unit 136 with the regulated luminance according to the image scanning scheme of the display panel 133 (S220). The display apparatus 100 emits the backlight in sequence row by row according to the image scanning order of the display panel 133. When the backlight unit 136 is operated as described above, the display apparatus 100 drives the backlight unit 136 in the progressive manner.

By driving the light sources of the backlight unit 136 in sequence according to the image scanning order of the display panel 133, the display apparatus 100 can prevent the crosstalk in the 3D image display.

By regulating the luminance during the lighting period of each light source at several values, the display apparatus 100 can reduce the luminance imbalance according to the location of the light source and uniformly maintain the luminance. When displaying the 3D image, the display apparatus 100 can prevent the crosstalk by enhancing the uniformity of the luminance.

The operation of the display apparatus according to an exemplary embodiment is described by referring to FIGS. 3A through 3D. FIGS. 3A through 3D depict the light sources of the backlight unit 136 with four rows. Note that the number of the light sources can vary.

FIG. 3A is a diagram of the backlight including the four rows according to an exemplary embodiment of the invention.

The backlight unit 136 is an edge type backlight unit which arranges the light sources along the left edge side and the right edge side of the display panel 133 as shown in FIG. 3A. The backlight unit 136 can emit the backlight to the four row regions of the display panel 133.

That is, the backlight unit 136 includes first-row light sources 310 and 315 for emitting the backlight to the first row region 351, second-row light sources 320 and 325 for emitting the backlight to the second row region 352, third-row light sources 330 and 335 for emitting the backlight to the third row region 353, and fourth-row light sources 340 and 345 for emitting the backlight to the fourth row region 354.

Figure 3B:
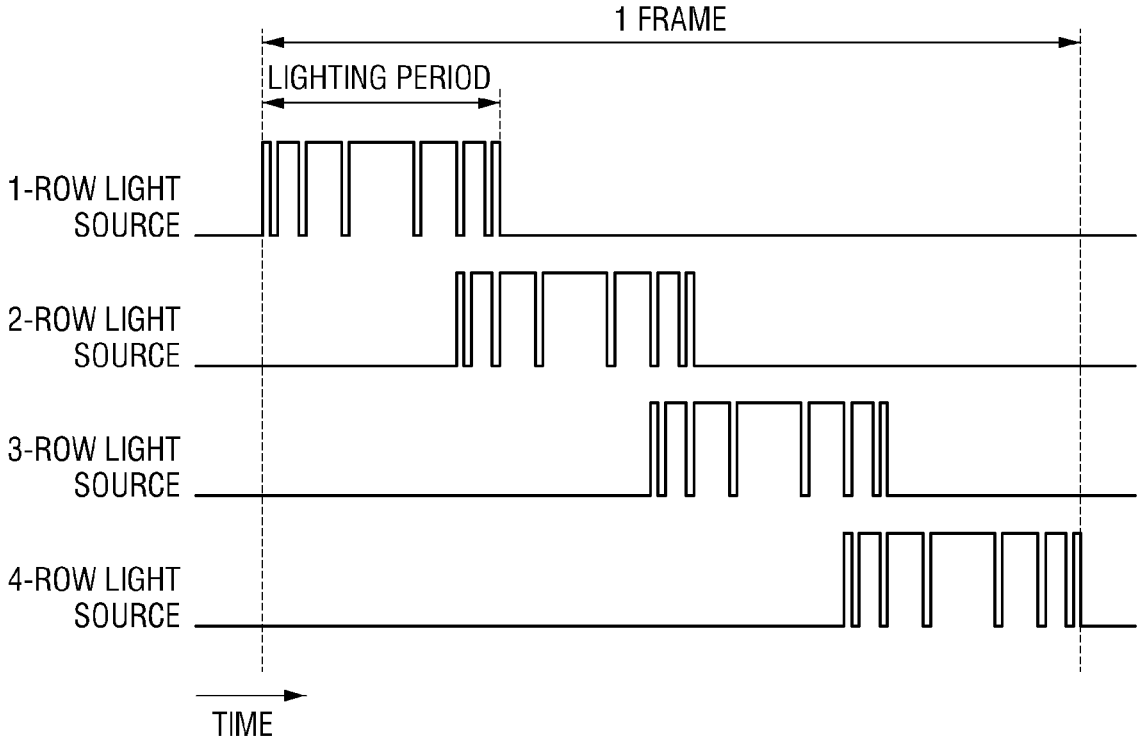
FIG. 3B is a diagram of a driving signal of light sources driven by a progressive driving scheme according to an exemplary embodiment.

Hereafter, the progressive driving of the backlight unit 136 of FIG. 3A is explained by referring to FIG. 3B. FIG. 3B depicts the driving signals of the light sources driven by the progressive driving scheme according to an exemplary embodiment.

In the period of one frame, the first-row light sources 310 and 315 are turned on first as shown in FIG. 3B. The second-row light sources 320 and 325, the third-row light sources 330 and 335, and the fourth-row light sources 340 and 345 are turned on in sequence.

The period for turning on the first-row light sources 310 and 315 is equal to the period for scanning the image in the first row region 351 of the display panel 133. The periods for turning on the second-row light sources 320 and 325, the third-row light sources 330 and 335, and the fourth-row light sources 340 and 345 are equal to the periods for scanning the image in the second row region 352, the third row region 535, and the fourth row region 354 of the display panel 133, respectively. As such, the display apparatus 100 drives the backlight unit 136 in the progressive manner by driving only the light sources corresponding to the image scan region in the display panel 133.

Figure 3C:
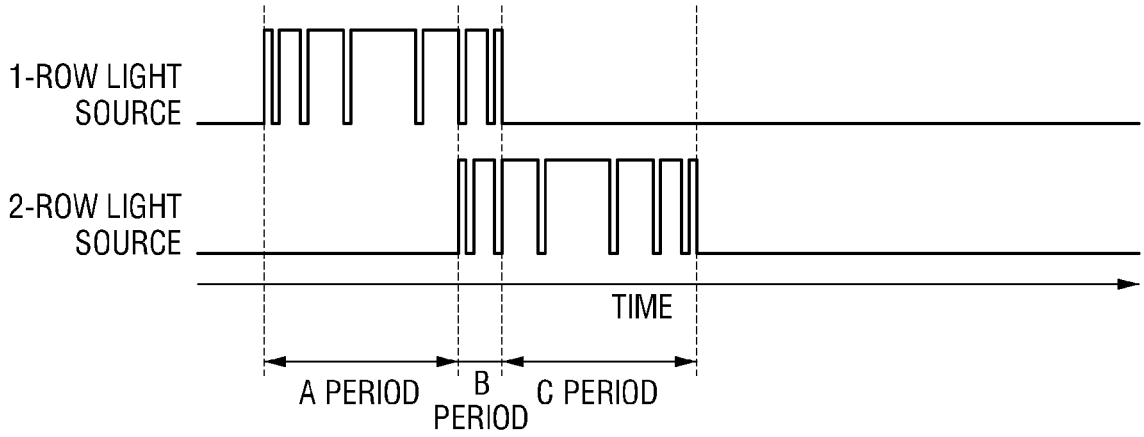
FIG. 3C is a detailed diagram of driving signals of the first-row light source and the second-row light source according to an exemplary embodiment.

The duty ratio differs between a period in which only one light source is turned on and a period in which two light sources are turned on, as shown in FIG. 3B, which is described in detail by referring to FIG. 3C.

FIG. 3C is a detailed diagram of the driving signals of the first-row light sources 310 and 315 and the second-row light sources 320 and 325 according to an exemplary embodiment. As shown in FIG. 3C, the periods for turning on the first-row light sources 310 and 315 are the A period and the B period, and the periods for turning on the second-row light sources 320 and 325 are the B period and the C period. The period for turning on both of the first-row light sources 310 and 315 and the second-row light sources 320 and 325 is the B period. During the B period, in which the first-row light sources 310 and 315 and the second-row light sources 320 and 325 are turned on, if the luminance is not lowered, the luminance during the B period gets too high. Hence, the display apparatus 100 decreases the luminance during the B period of the first-row light sources 310 and 315 and the second-row light sources 320 and 325 by lowering the duty ratio of the B period. The display apparatus 100 causes the luminance of the first-row light sources 310 and 315 during the A period to equal the sum of the luminance of the first-row light sources 310 and 315 and the luminance of the second-row light sources 320 and 325 during the B period. Thus, the display apparatus 100 can equalize the average luminance during the A period, the B period, and the C period, which is be explained by referring to FIG. 3D.

Figure 3D:
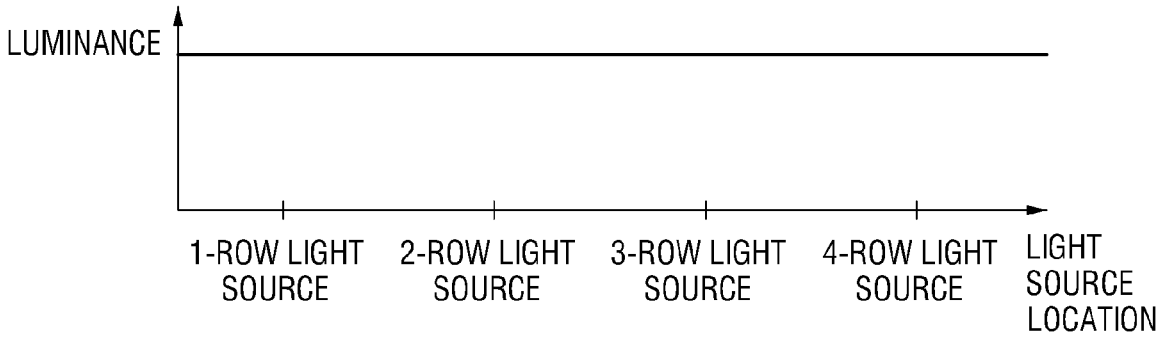
FIG. 3D is a diagram of luminance distribution according to a location of the light source according to an exemplary embodiment.

FIG. 3D depicts luminance distribution according to the location of the light source according to an exemplary embodiment. As shown in FIG. 3D, when the luminance is regulated as described above, the luminance value based on the location of the light source is static.

By contrast, a related art progressive driving scheme provides uneven luminance distribution according to the location of the light source, which is shown in FIGS. 4A through 5B.

Figure 4A:
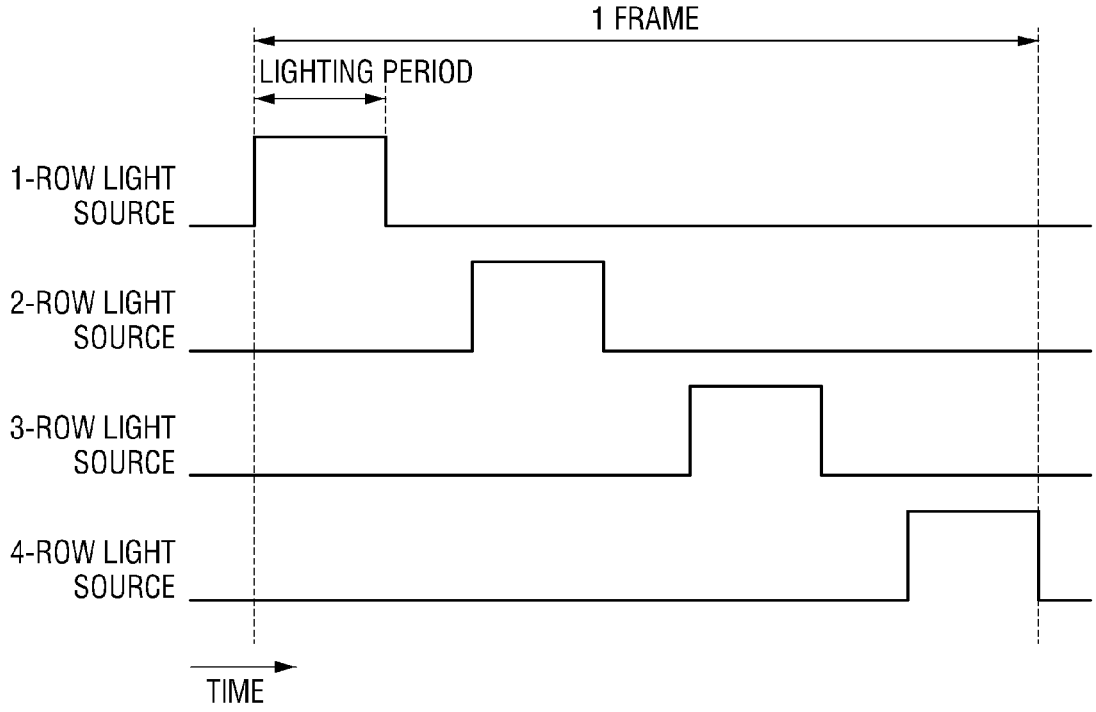
FIG. 4A (RELATED ART)
FIGS. 4A and 4B are diagrams of the driving signal of the backlight and the luminance distribution according to a related art progressive driving scheme.
Figure 4B:
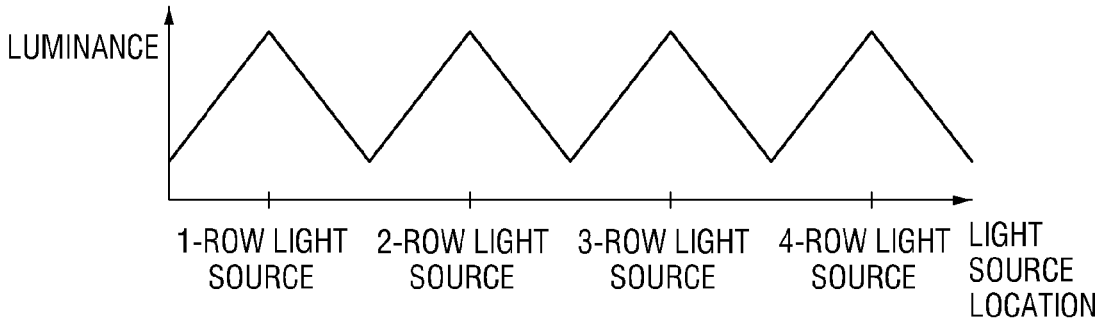
FIG. 4B (RELATED ART)

FIGS. 4A and 4B depict the driving signals of the backlight and the luminance distribution according to a related art progressive driving scheme. When the luminance of the light sources in each row is constant during the lighting period and the lighting periods do not overlap each other as shown in FIG. 4A, the luminance near the light source is high and the luminance in the regions between the light sources is low, as shown in FIG. 4B.

Figure 5A:
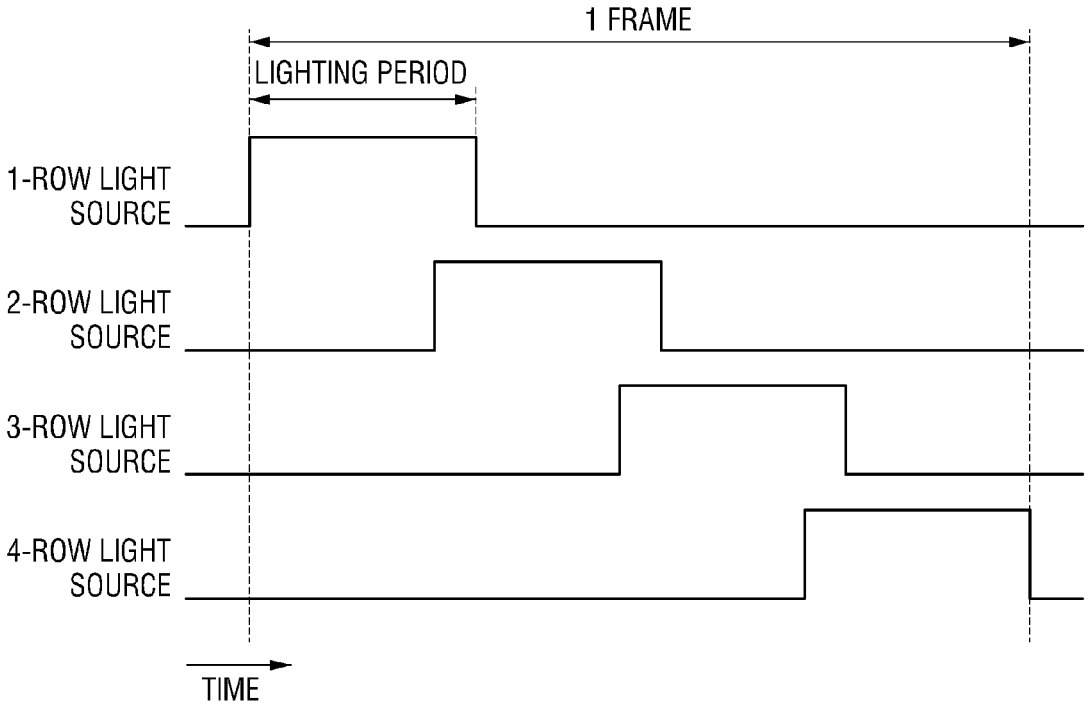
FIG. 5A (RELATED ART)
FIGS. 5A and 5B are diagrams of the driving signal of the backlight and the luminance distribution according to another related art progressive driving scheme.
Figure 5B:
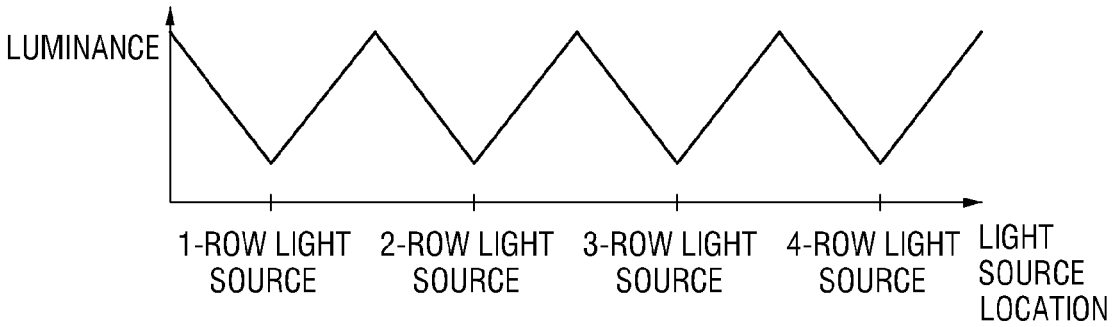
FIG. 5B (RELATED ART)

FIGS. 5A and 5B depict the driving signals of the backlight and the luminance distribution according to another related art progressive driving scheme. When the luminance is constant during the lighting period of the light sources of each row and the lighting periods overlap each other as shown in FIG. 5A, the luminance where the light source is located is low and the region between the light sources is high as shown in FIG. 5B.

As such, while the related art methods of FIGS. 4A through 5B exhibit the uneven luminance according to the location of the light source, the display apparatus 100 according to an exemplary embodiment exhibits uniform luminance regardless of the location of the light source.

By regulating the luminance during the lighting period of each light source at several values, the display apparatus 100 can address the light unevenness with respect to the location of the light source and uniformly maintain the luminance. In addition, when displaying the 3D image, the display apparatus 100 can prevent the crosstalk by enhancing the uniformity of the luminance.

While the backlight shown in the exemplary embodiments is an edge type backlight, any backlight type drivable by the progressive scheme can be applied.

While the luminance is controlled by controlling the duty ratio of the driving signal applied to the light source by way of example, any dimming scheme capable of regulating luminance can be applied. For example, the luminance may be controlled by controlling the amplitude of the driving signal.

Note that the present display apparatus 100 can employ any device capable of displaying the image using the backlight. For example, the display apparatus 100 can be an LCD TV, a 3D TV, a monitor, a notebook, a PMP, and so forth.

The foregoing exemplary embodiments are merely exemplary and are not to be construed as limiting the present disclosure. The present teaching can be readily applied to other types of apparatuses. Also, the description of the exemplary embodiments of the present disclosure is intended to be illustrative, and not to limit the scope of the claims, and many alternatives, modifications, and variations will be apparent to those skilled in the art.

What is claimed is:

1. A display apparatus comprising:

a backlight unit comprising a plurality of light sources that emit backlight; and a controller configured to control the plurality of light sources of the backlight unit according to an image scanning scheme, wherein the plurality of light sources comprise a first light source and a second light source, wherein the controller controls the first light source to emit backlight during a first lighting period and to be turned off during a first non-lighting period and controls the second light source to emit backlight during a second lighting period and to be turned off during a second non-lighting period, wherein the first lighting period partially overlaps with the second lighting period during an overlapping period, and the first lighting period includes a first non-overlapping period and the overlapping period, and the second lighting period includes the overlapping period and a second non-overlapping period, and wherein the controller decreases a luminance of the first light source during the overlapping period to a first level which is below a luminance of the first light source for the first non-overlapping period and above a luminance of the first light source for the first non-lighting period, and decreases a luminance of the second light source during the overlapping period to a second level which is below a luminance of the second light source for the second non-overlapping period and above a luminance of the second light source for the second non-lighting period.

2. The display apparatus of claim 1, further comprising a display panel configured to display an image;

wherein the plurality of light sources emit backlight to the display panel.

3. The display apparatus of claim 2, wherein the plurality of the light sources emit the backlight according to rows of the display panel, and the controller controls the plurality of light sources to emit the backlight in sequence row by row, according to the image scanning scheme.

4. The display apparatus of claim 3, wherein the controller controls the plurality of light sources of the backlight unit to emit the backlight according to a progressive scheme.

5. The display apparatus of claim 3, wherein the backlight unit is an edge type backlight unit in which the plurality of light sources are arranged on a left edge side and a right edge side of the display panel.

6. The display apparatus of claim 3, wherein the backlight unit comprises at least two rows including a first row and a second row;

wherein the first light source of the plurality of light sources emits backlight corresponding to the first row, and the second light source of the plurality of light sources emits backlight corresponding to the second row.

7. The display apparatus of claim 6, wherein the controller causes a sum of the first light source luminance and the second light source luminance during the overlapping period in which the first and second lighting periods overlap to be equal to the first light source luminance of the first non-overlapping period.

8. The display apparatus of claim 6, wherein a third light source of the plurality of light sources emits backlight corresponding to the first row, and a fourth light source of the plurality of light sources emits backlight corresponding to the second row;

wherein the first light source is disposed at a first end of the first row and the third light source is disposed at a second end of the first row; and wherein the second light source is disposed at a first end of the second row and the fourth light source is disposed at a second end of the second row.

9. The display apparatus of claim 8, wherein the first end of the first row and the first end of the second row are disposed on a left edge side of the display panel, and the second end of the first row and the second end of the second row are disposed on a right edge side of the display panel.

10. The display apparatus of claim 2, wherein the display panel displays a 3D image comprising a left-eye image and a right-eye image, and the controller controls the plurality of light sources of the backlight unit according to a 3D image scanning scheme in the display panel.

11. The display apparatus of claim 1, wherein the controller controls a luminance of each light source of the plurality of light sources to make the total luminance of the backlight emitted from the backlight unit uniform with respect to a location of each light source of the plurality of light sources by controlling a duty ratio of a driving signal applied to the each light source of the plurality of light sources.

12. The display apparatus of claim 1, wherein the controller decreases the luminance of the first light source in the overlapping period by decreasing a duty cycle of a driving signal applied to the first light source.

13. The display apparatus of claim 1, wherein the controller decreases the luminance of the second light source in the overlapping period by decreasing a duty cycle of a driving signal applied to the second light source.

14. A method for driving a backlight of a display apparatus which comprises a backlight unit comprising a plurality of light sources that emit backlight, the method comprising:

controlling a luminance of each light source of the plurality of light sources; and driving the plurality of light sources according to an image scanning scheme, wherein the plurality of light sources comprise a first light source and a second light source, wherein the controlling comprises controlling the first light source to emit backlight during a first lighting period and to be turned off during a first non-lighting period and controlling the second light source to emit backlight during a second lighting period and to be turned off during a second non-lighting period, wherein the first lighting period partially overlaps with the second lighting period during an overlapping period, and the first lighting period includes a first non-overlapping period and the overlapping period, and the second lighting period includes the overlapping period and a second non-overlapping period, and wherein the controlling the first light source comprises decreasing a luminance of the first light source during the overlapping period to a first level which is below a luminance of the first light source for the first non-overlapping period and above a luminance of the first light source for the first non-lighting period, and the controlling the second light source comprises decreasing a luminance of the second light source during the overlapping period to a second level which is below a luminance of the second light source for the second non-overlapping period and a luminance of the second light source for the second non-lighting period.

15. The method of claim 14, wherein the display apparatus comprises a display panel to display an image, and wherein the driving drives the plurality of light sources of the backlight unit to emit backlight according to rows of the display panel in sequence row by row, according to the image scanning scheme.

16. The method of claim 15, wherein the driving drives the plurality of light sources of the backlight unit according to a progressive scheme.

17. The method of claim 15, wherein the backlight unit is an edge type backlight unit in which the plurality of light sources are arranged on a left edge side and a right edge side of the display panel.

18. The method of claim 15, wherein the backlight unit comprises at least two rows including a first row and a second row, wherein the first light source of the plurality of light sources emits backlight corresponding to the first row, and the second light source of the plurality of light sources emits backlight corresponding to the second row.

19. The method of claim 18, wherein the driving further comprises controlling a sum of the first light source luminance and the second light source luminance during the overlapping period in which the first and second periods overlap, to be equal to the first light source luminance of the first lighting period.

20. The method of claim 18, wherein the decreasing the luminance of the first light source in the overlapping period comprises decreasing a duty cycle of a driving signal applied to the first light source.

21. The method of claim 18, wherein the decreasing the luminance of the second light source in the overlapping period comprises decreasing a duty cycle of a driving signal applied to the second light source.

22. The method of claim 14, wherein the controlling controls the luminance of each light source of the plurality of light sources to make the total luminance of the backlight emitted from the backlight unit uniform with respect to a location of each light source of the plurality of light sources by controlling a duty ratio of a driving signal applied to the each light source of the plurality of light sources.

23. The method of claim 14, wherein the driving drives the plurality of light sources of the backlight unit according to a scheme for scanning a 3D image which comprises a left-eye image and a right-eye image in the display panel.

* * * * *